US007090470B2

(12) United States Patent
Kim

(10) Patent No.: US 7,090,470 B2
(45) Date of Patent: Aug. 15, 2006

(54) APPARATUS AND METHOD FOR PREVENTING A PISTON AND VALVE COLLISION IN A LINEAR COMPRESSOR

(75) Inventor: Tae-Duk Kim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/184,946

(22) Filed: Jul. 1, 2002

(65) Prior Publication Data

US 2003/0099550 A1 May 29, 2003

(30) Foreign Application Priority Data

Nov. 27, 2001 (KR) ..... 2001-74199

(51) Int. Cl.
*F04B 49/06* (2006.01)

(52) U.S. Cl. ..... 417/44.11; 417/53; 417/417; 417/214; 318/437; 318/438; 318/432; 318/71; 318/433

(58) Field of Classification Search ..... 417/53, 417/44.11, 416, 417, 214; 318/432, 433, 318/635, 650, 71, 437, 438
See application file for complete search history.

(56) References Cited

U.S. PATENT DOCUMENTS

| | | | | |
|---|---|---|---|---|
| 4,330,237 | A * | 5/1982 | Battah | 417/2 |
| 5,235,259 | A * | 8/1993 | Dhindsa et al. | 318/434 |
| 5,342,176 | A * | 8/1994 | Redlich | 417/212 |
| 5,897,296 | A * | 4/1999 | Yamamoto et al. | 417/44.1 |
| 6,074,172 | A * | 6/2000 | Huang | 417/214 |
| 6,176,683 | B1 * | 1/2001 | Yang | 417/44.1 |
| 6,577,097 | B1 * | 6/2003 | Krefta et al. | 318/801 |
| 2002/0064461 | A1 * | 5/2002 | Yoo et al. | 417/44.1 |
| 2002/0064462 | A1 * | 5/2002 | Park et al. | 417/44.1 |
| 2002/0150477 | A1 * | 10/2002 | Hwang et al. | 417/44.1 |
| 2003/0129063 | A1 * | 7/2003 | Jeun | 417/45 |

* cited by examiner

*Primary Examiner*—Tae Jun Kim
*Assistant Examiner*—Emmanuel Sayoc
(74) *Attorney, Agent, or Firm*—Staas & Halsey LLP

(57) ABSTRACT

An apparatus and method for controlling a linear compressor is provided. The linear compressor controlling apparatus includes a voltage detection unit, a current detection unit, a control unit and a compressor drive unit. The voltage detection unit detects a voltage supplied to the linear compressor, while the current detection unit detects a current supplied to the linear compressor. The control unit determines whether a collision of a piston of the compressor with a valve of the compressor occurs using output signals of the voltage and current detection units, and controls the amplitude of the piston if the collision of the piston with the valve occurs. The compressor drive unit controls the amplitude of the piston under the control of the control unit.

3 Claims, 4 Drawing Sheets

APPARATUS AND METHOD FOR PREVENTING A PISTON AND VALVE COLLISION IN A LINEAR COMPRESSOR

CROSS-REFERENCE TO RELATED APPLICATIONS

This application claims the benefit of Korean Application No. 2001-74199 filed Nov. 27, 2001, in the Korean Intellectual Property Office, the disclosure of which is incorporated herein by reference.

BACKGROUND OF THE INVENTION

1. Field of the Invention

The present invention relates to an apparatus and method for controlling a linear compressor, which can prevent a piston of the compressor from colliding with a valve of the compressor, thereby improving the efficiency of operation of the compressor.

2. Description of the Related Art

FIG. 1 is a block diagram showing a conventional apparatus for controlling a linear compressor.

Referring to FIG. 1, the conventional control apparatus comprises a core 10 made of magnetic material and operated in conjunction with an object of detection, first and second coils 12 and 13 symmetrically wound around the core 10, and a signal processing unit 20 for detecting a change in the position of the core 10 using voltages induced to the first and second coils 12 and 13 and outputting the detected change.

The signal processing unit 20 comprises a first full-wave rectification unit 21 for full-wave rectifying a voltage induced in the first coil 12, a second full-wave rectification unit 22 for full-wave rectifying a voltage induced in the second coil 13, a differential amplification unit 23 for performing differential amplification by a difference between the voltages full-wave rectified by the first and second full-wave rectification units 21 and 22, a filter unit 24 for removing high-frequency components from a signal outputted from the differential amplification unit 23, and a peak detection unit 25 for detecting the highest and lowest values of a signal outputted from the filter unit 24 and transmitting the highest and lowest values to a microcomputer 30.

The operation of the conventional control apparatus is described below.

If the position of the core 10 is changed by a change in the position of the object of detection while alternating current with a frequency of several KHz is applied to the first and second coils 12 and 13, voltage proportional to the change in the position of core 10 is induced in the first and second coils 12 and 13. The voltage induced in the first and second coils 12 and 13 is full-wave rectified in the first and second full-wave rectification units 21 and 22, respectively, and inputted to the respective input terminals of the differential amplification unit 23.

The differential amplification unit 23 performs differential amplification by a difference between the voltages full-wave rectified by the first and second full-wave rectification units 21 and 22, and outputs an amplified signal to the filter unit 24. The filter unit 24 removes high-frequency components from the signal outputted from the differential amplification unit 23, amplifies the signal with the high-frequency components removed and outputs the amplified signal with the high-frequency components removed to the peak detection unit 25. The peak detection unit 25 full-wave rectifies the signal outputted from the filter unit 24 and outputs the rectified signal to the microcomputer 30. The microcomputer 30 controls the stroke of the linear compressor according to the full-wave rectified signal outputted from the filter unit 24.

The conventional linear compressor controlling apparatus can keep its stroke constant by controlling only the stroke detected by a sensor or the like. However, the center position of a piston of the linear compressor is changed according to load, therefore a constant top clearance of the piston cannot be maintained with respect to the top dead center of the piston. As a result, a problem arises that the piston of the linear compressor collides with the valve of the linear compressor.

SUMMARY OF THE INVENTION

Accordingly, the present invention provides an apparatus and method for controlling a linear compressor, which can control the top clearance of the piston with respect to the top dead center of the piston without using an additional sensor, so the piston is prevented from colliding with the valve of the compressor, thereby improving the efficiency of operation of the compressor.

Additional objects and advantages of the invention will be set forth in part in the description which follows and, in part, will be obvious from the description, or may be learned by practice of the invention.

To accomplish the above and other objects, the present invention provides an apparatus for controlling a linear compressor, comprising: a voltage detection unit detecting a voltage supplied to the linear compressor; a current detection unit detecting a current supplied to the linear compressor; a control unit determining whether the collision of the piston of the compressor with the valve of the compressor occurs using output signals of the voltage and current detection units and controlling the amplitude of the piston if the collision of the piston with the valve occurs; and a compressor drive unit controlling the amplitude of the piston under the control of the control unit.

In addition, the present invention provides a method of controlling a linear compressor, comprising : setting a maximum conduction angle according to an input voltage of the linear compressor; and adjusting the conduction angle after the setting according to an operation pattern and consumed current of the linear compressor.

BRIEF DESCRIPTION OF THE DRAWINGS

These and other objects and advantages of the invention will become apparent and more readily appreciated from the following description of the preferred embodiments, taken in conjunction with the accompanying drawings of which:

FIGS. 3A and 3B are graphs showing current waveforms with regard to input voltages in accordance with the present invention.

DESCRIPTION OF THE PREFERRED EMBODIMENTS

Figure 1:
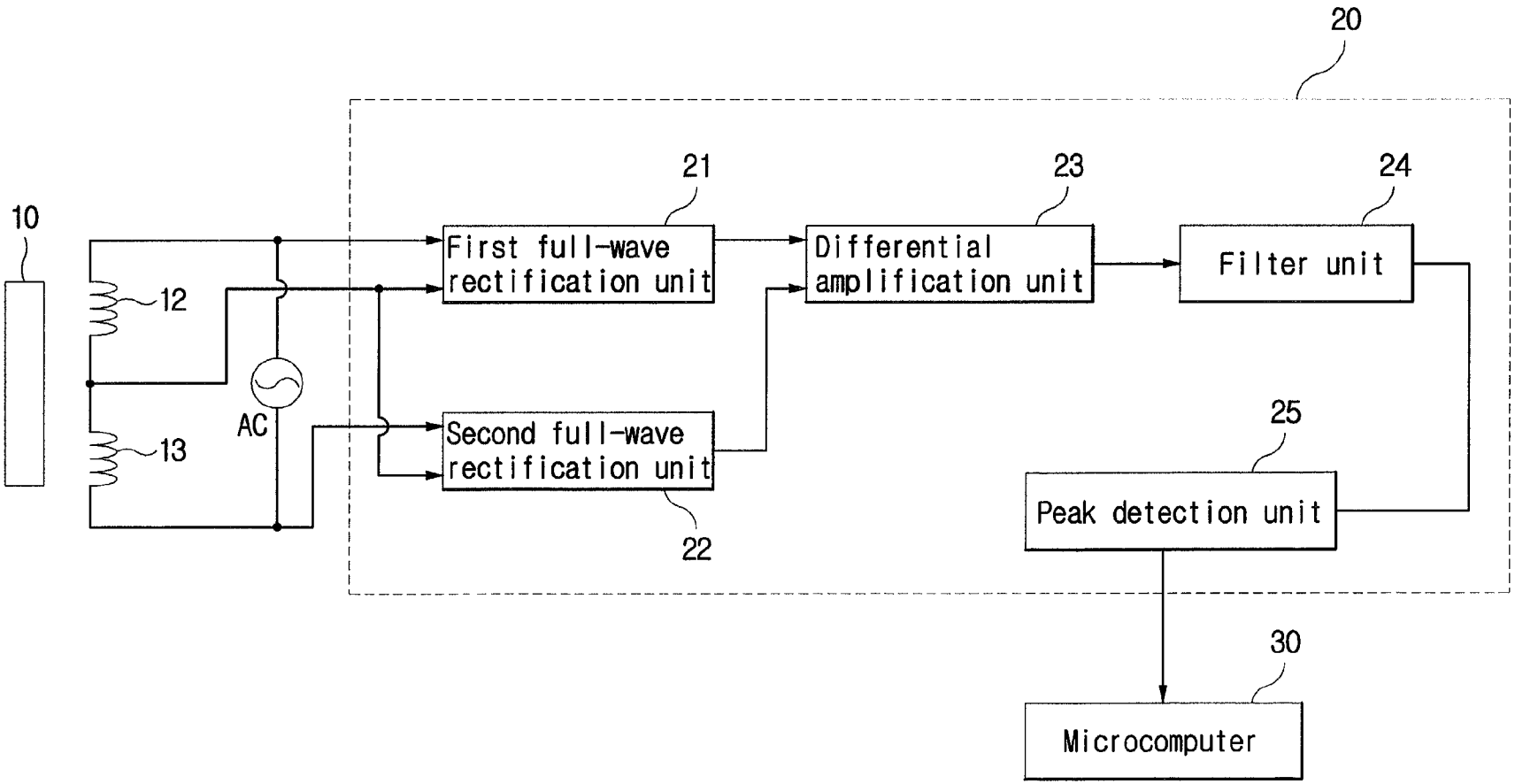
FIG. 1 (PRIOR ART)
FIG. 1 is a block diagram of a conventional apparatus for controlling a linear compressor.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
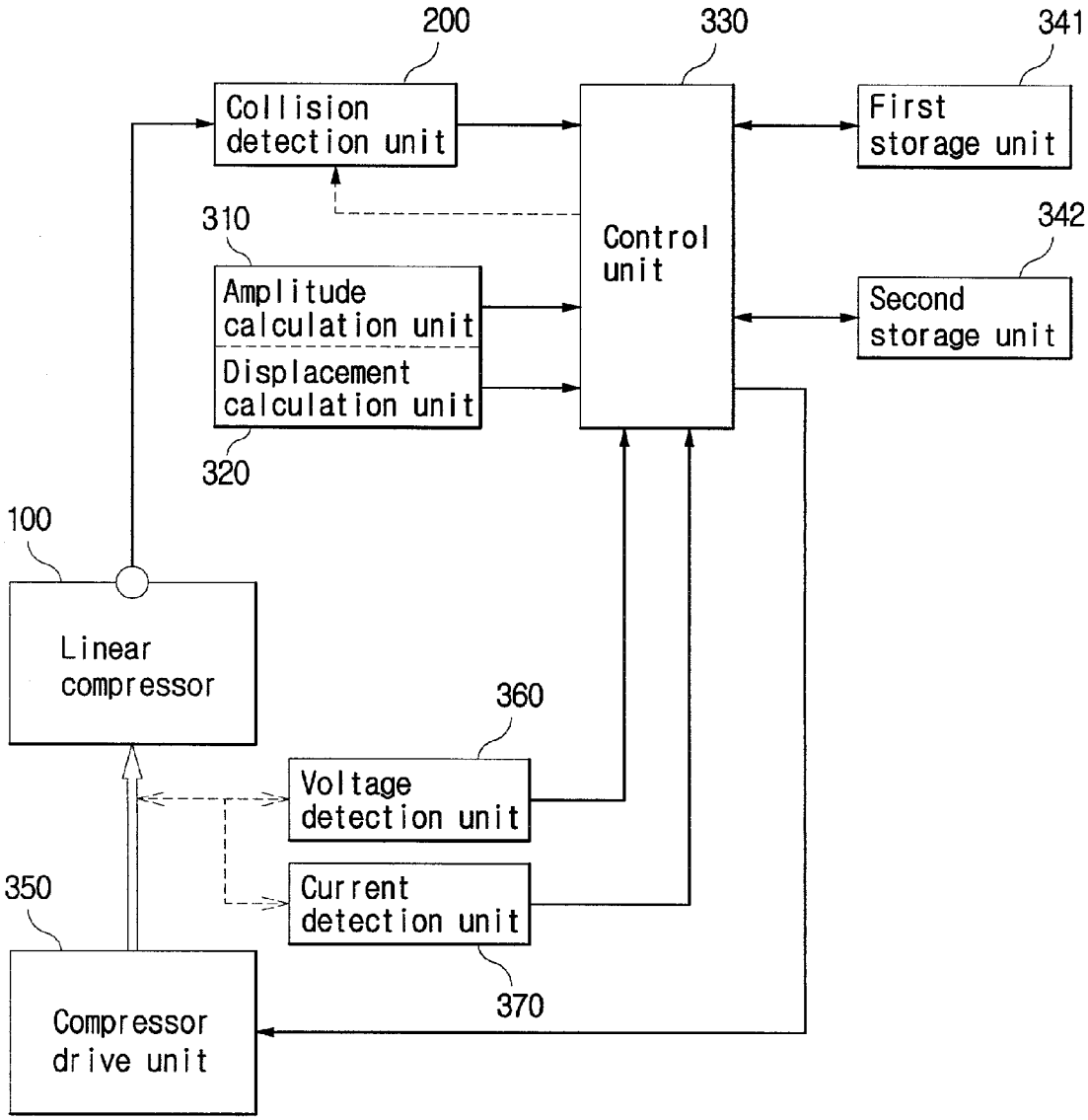
FIG. 2 is a block diagram of an apparatus for controlling a linear compressor in accordance with an embodiment of the present invention.

FIG. 2 is a block diagram of an apparatus for controlling a linear compressor in accordance with an embodiment of the present invention.

Referring to FIG. 2, the compressor controlling apparatus of the present invention comprises a control unit 330 controlling the overall operation of the apparatus, a compressor drive unit 350 driving a linear compressor 100 under the control of the control unit 330, a collision detection unit 200 detecting the collision of a piston with a valve during the operation of the linear compressor 100, an amplitude calculation unit 310 calculating the amplitude of the piston using the output signal of the collision detection unit 200, and a displacement calculation unit 320 calculating the displacement of the piston. The linear compressor controlling apparatus further comprises a first storage unit 341 storing preset maximum amplitude data and a second storage unit 342 storing reset maximum amplitude data. The second storage unit 342 preferably includes non-volatile memory that allows reading from or writing to the control unit 330. The linear compressor controlling apparatus further comprises a voltage detection unit 360 detecting a voltage supplied to the linear compressor 100 and a current detection unit 370 detecting a current supplied to the linear compressor 100.

Figure 3A:
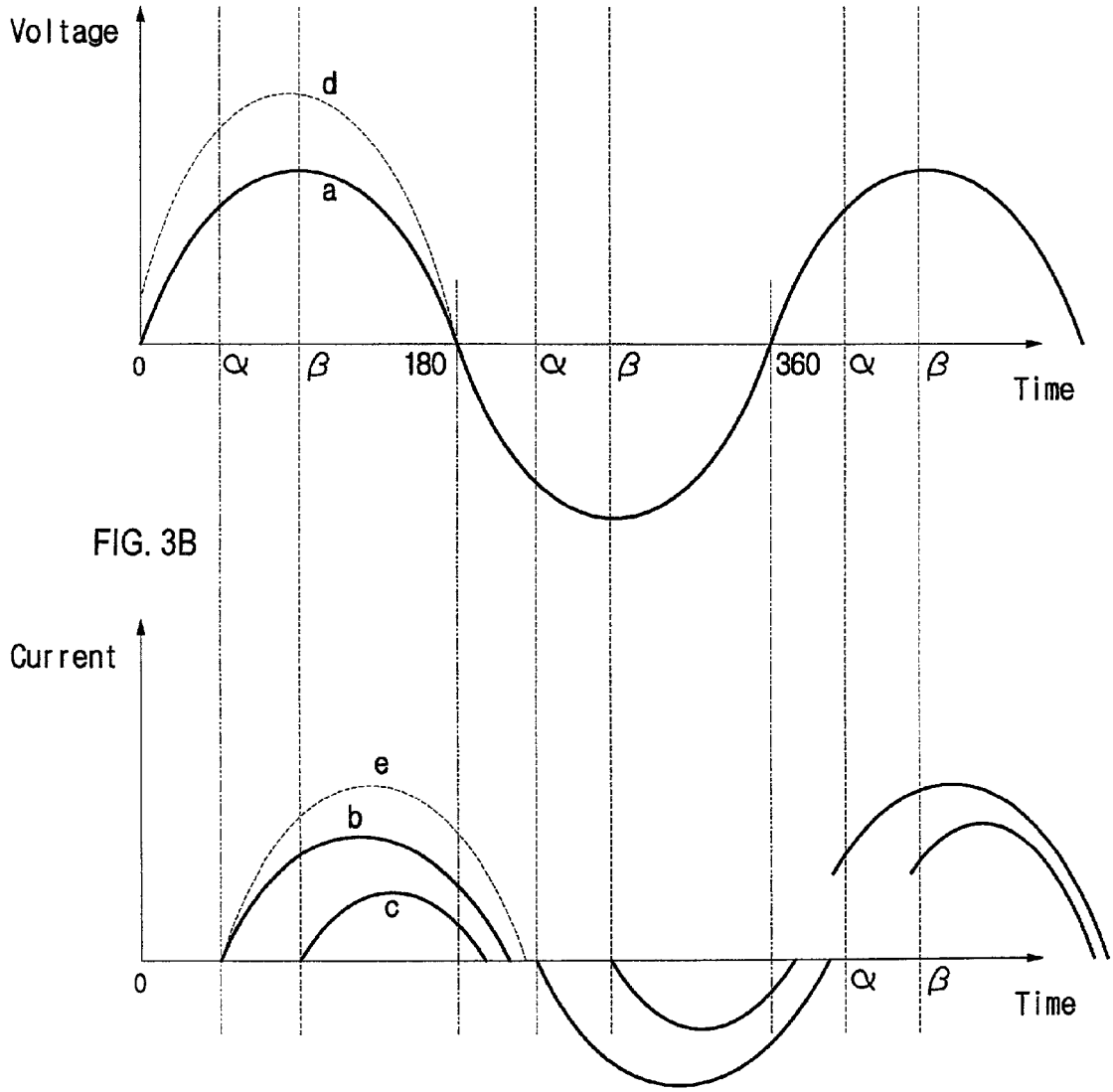

FIGS. 3A and 3B are graphs showing current waveforms with regard to input voltages in accordance with the present invention.

Referring to FIGS. 3A and 3B, "a" denotes a reference input voltage, and "d" denotes an increase in the reference input voltage formed when the reference input voltage is increased, "b" denotes a current waveform formed when a conduction angle is $\alpha$, "c" denotes a current waveform formed when a conduction angle is $\beta$, and "e" denotes a current waveform formed when the reference input voltage is increased from "a" to "d".

Hereinafter, a method of controlling a linear compressor in accordance with the present invention is described.

Figure 4:
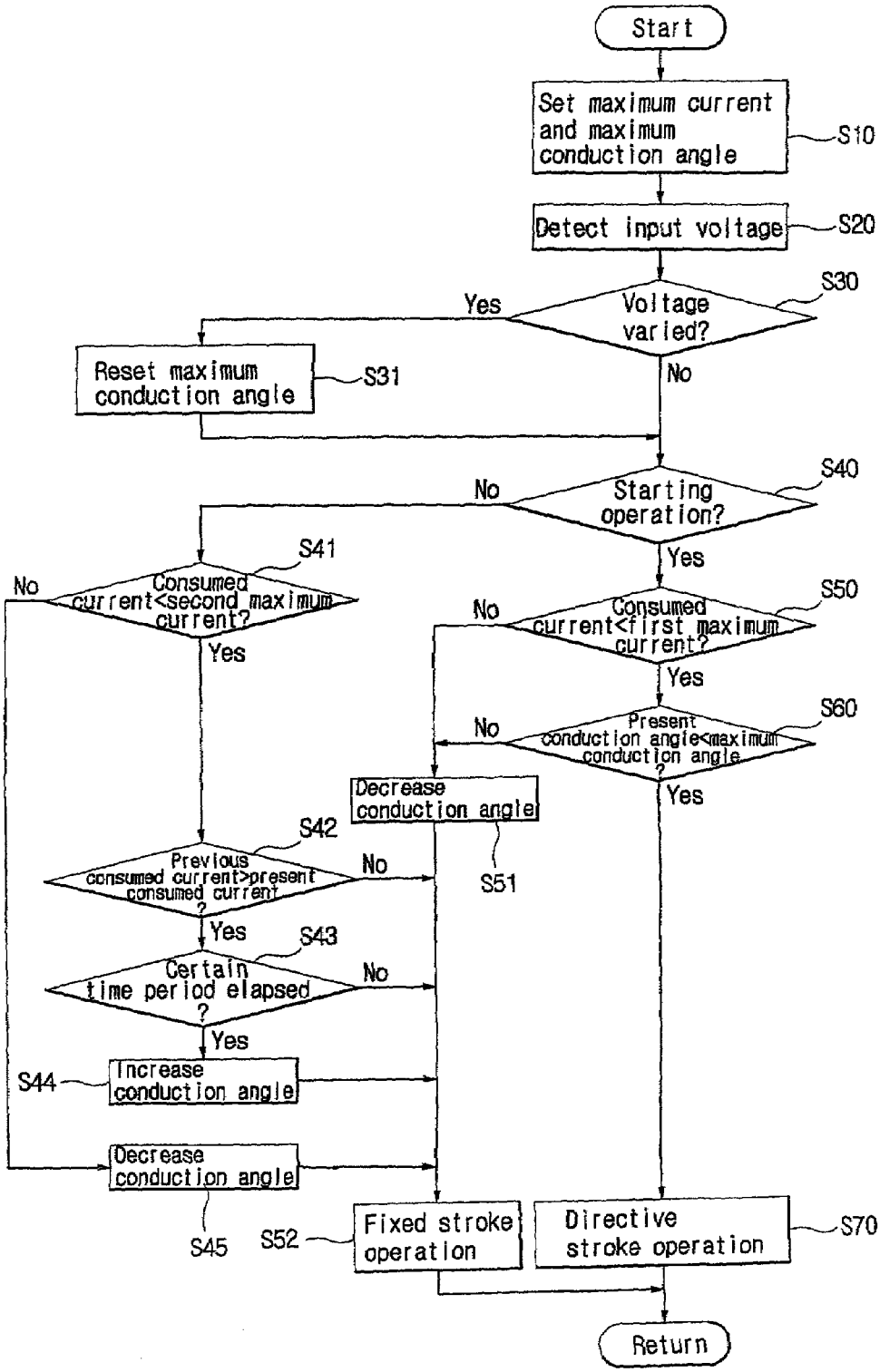
FIG. 4 is a flowchart showing a method of controlling the linear compressor in accordance with an embodiment of the present invention.

FIG. 4 is a flowchart showing the method of controlling the linear compressor in accordance with the present invention.

Referring to FIG. 4, the control unit 330 sets a maximum current and a maximum conduction angle in accordance with the data of the first storage unit 341 at S10.

The control unit 330 detects an input voltage supplied to the linear compressor 100 by the voltage detection unit 360 at S20. Additionally, the control unit 330 determines whether the detected input voltage has varied by more than a certain reference value at S30.

If the input voltage has varied by more than a certain reference value at S30, the control unit 330 resets the maximum conduction angle to a value preset according to the variation of the input voltage at S31.

The control unit 330 determines whether the present operation of the linear compressor 100 is a starting operation at S40. At S40, the present operation is determined as a normal operation if at least a certain period of time has elapsed since the application of power to the linear compressor 100, while the present operation is determined as the starting operation if at least a certain period of time has not elapsed since the application of power to the linear compressor 100.

If the operation of the linear compressor 100 is the starting operation at S40, the control unit 100 detects a consumed current by the current detection unit 370 and determines whether the detected consumed current is smaller than the preset first maximum current at S50.

If the consumed current is smaller than the first maximum current at S50, the control unit 330 determines whether a present conduction angle is smaller than the maximum conduction angle, which is set at S10, at S60.

If the present conduction angle is smaller than the maximum conduction angle, the control unit 330 controls the compressor drive unit 350 so that the linear compressor 100 performs a directive stroke operation in which the linear compressor 100 increases or decreases the size of the stroke of the piston in response to a command from the control unit, at S70.

If the consumed current is greater than or equal to the first maximum current at S50 or the present conduction angle is greater than or equal to the maximum conduction angle at S60, the control unit 330 decreases the conduction angle at S51. If the conduction angle is decreased, the size of the stroke is decreased. Additionally, the control unit 330 controls the compressor drive unit 350 so that the linear compressor 100 performs a fixed stroke operation in which the linear compressor 100 maintains a stroke of a constant size at S52.

Meanwhile, if the present operation of the linear compressor 100 is not the starting operation at S40, the control unit 330 detects a consumed current by the current detection unit 370 and determines whether the detected, consumed current is smaller than the second maximum current at S41. If the consumed current is smaller than the second maximum current at S41, the control unit 330 stores the detected consumed current as present consumed current in the storage unit 342 and determines whether the previous consumed current is greater than the present consumed current at S42.

If the previous consumed current is greater than the present consumed current at S42, the control unit 330 increases a time count and determines whether a certain period of time has elapsed at S43. If a certain period of time has elapsed at S43, the control unit 330 resets the time count and increases the conduction angle at S44. When the conduction angle is increased, the size of the stroke of the piston is increased. The control unit 330 controls the compressor drive unit 350 so that the linear compressor 100 performs a fixed stroke operation in which a present stroke is maintained at S52.

If the consumed current is greater than or equal to the second maximum current, the control unit 330 determines the stroke of the piston as being excessive and reduces the conduction angle to decrease the size of the stroke at S45. Additionally, the control unit 330 controls the compressor drive unit 350 so that the linear compressor 100 performs a fixed stroke operation in which the present size of the stroke is maintained at S52.

However, if the previous consumed current is smaller than or equal to the present maximum current at S42 or a certain period of time has not elapsed at S43, the control unit 330 does not control the conduction angle, and controls the compressor drive unit 350 so that the linear compressor 100 performs a fixed stroke operation in which the present size of the stroke is maintained at S52.

As described above, the present invention provides an apparatus and method for controlling a linear compressor, which can minimize the top clearance of the piston of the compressor, so the piston is prevented from colliding with the valve of the compressor, thereby improving the efficiency of operation of the compressor.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus for controlling a linear compressor having a piston and a valve, comprising:

a voltage detection unit detecting a voltage supplied to the linear compressor;

a current detection unit detecting a current supplied to the linear compressor;

a control unit determining whether a collision of the piston with the valve occurs by comparing output signals of the voltage and current detection units and controlling an amplitude of the piston if the collision of the piston with the valve occurs;

a compressor drive unit controlling the amplitude of the piston under control of the control unit;

a first storage unit storing preset data and a second storage unit storing data reset by the control unit, the second storage unit being a non-volatile memory that allows reading or writing by the control unit to control the amplitude of the piston;

a collision detection unit detecting the collision of the piston with the valve in accordance with the output signals of the voltage detection unit and the current detection unit; and an amplitude calculation unit calculating the amplitude of the piston using an output signal of the collision detection unit and providing the control unit with the calculated amplitude of the piston.

2. An apparatus for controlling a linear compressor having a piston and a valve comprising:

a voltage detection unit detecting a voltage supplied to the linear compressor;

a current detection unit detecting a current supplied to the linear compressor;

a control unit determining whether a collision of the piston with the valve occurs by comparing output signals of the voltage and current detection units and controlling an amplitude of the piston if the collision of the piston with the valve occurs;

a conduction angle setting unit setting a maximum conduction angle of the linear compressor according to the voltage supplied to the linear compressor; and a conduction angle adjustment unit adjusting a conduction angle set by said conduction angle setting unit according to an operation pattern and a consumed current of the linear compressor.

3. The apparatus according to claim 1, wherein if the collision is determined the control unit controls the amplitude of the piston differently than if the collision is not determined.

* * * * *

UNITED STATES PATENT AND TRADEMARK OFFICE

CERTIFICATE OF CORRECTION

PATENT NO. : 7,090,470 B2
APPLICATION NO. : 10/184946
DATED : August 15, 2006
INVENTOR(S) : Tae-Duk Kim It is certified that error appears in the above-identified patent and that said Letters Patent is hereby corrected as shown below:

Col. 6, line 28, after “determined” insert --,--

Signed and Sealed this

Twenty-sixth Day of December, 2006

JON W. DUDAS
*Director of the United States Patent and Trademark Office*